US006098239A

United States Patent [19]

Vosbikian

[11] Patent Number: 6,098,239

[45] Date of Patent: Aug. 8, 2000

[54] CLEANING AID STORAGE MOP

[75] Inventor: Peter S. Vosbikian, Morrestown, N.J.

[73] Assignee: Quickie Manufacturing Corporation, Cinnaminson, N.J.

[21] Appl. No.: 09/469,775

[22] Filed: Dec. 22, 1999

[51] Int. Cl.[7] ..... A47L 13/20

[52] U.S. Cl. ..... 15/228; 15/231

[58] Field of Search ..... 15/228, 231, 232

[56] References Cited

U.S. PATENT DOCUMENTS

| | | | |
|---|---|---|---|
| 2,585,061 | 2/1952 | Webster, Jr. | 15/231 |
| 3,099,855 | 8/1963 | Nash | 15/231 |
| 4,106,153 | 8/1978 | Lemelson | 15/231 |
| 4,152,803 | 5/1979 | Gersin et al. | 15/231 X |
| 4,712,268 | 12/1987 | Heinonen | 15/231 |
| 4,940,139 | 7/1990 | Sandt | 206/362.2 |
| 5,012,542 | 5/1991 | Lynn | 15/1 |

FOREIGN PATENT DOCUMENTS

| | | | |
|---|---|---|---|
| 1442143 | 5/1966 | France | 15/231 |
| 126767 | 9/1928 | Switzerland | 15/231 |
| 332759 | 11/1958 | Switzerland | 15/231 |

*Primary Examiner*—Mark Spisich
*Attorney, Agent, or Firm*—Stuart M. Goldstein

[57] ABSTRACT

A dust mop with a handle and mop and attached mop head which contains one or more compartments. The compartments within the base of the mop head are used to store replacement electrostatic dust accumulating cleaning sheets. As the cleaning sheet in use on the mop head becomes full of dust, it is removed from the mop head and discarded. A fresh sheet is simply and conveniently retrieved from a compartment in the mop head and immediately replaced on the cleaning surface of the mop head. There is no interruption of work or downtime in searching for a replacement sheet or finding one in a remote location. This mop head configuration provides an efficient and effective apparatus of performing the dust mopping procedure. Different mop bases are disclosed which employ several alternate devices for removal of cleaning sheets from the mop head.

60 Claims, 7 Drawing Sheets

CLEANING AID STORAGE MOP

BACKGROUND OF INVENTION

Dry dust type mops have long been used as popular and efficient cleaning tools. One form of dust mop employs a solid cleaning head member connected to a mop handle. The mop head is used to clean, polish, or dust floor, wall, or similar surfaces. Recently, there has been much interest in dust mops which use disposable cleaning sheets. Such cleaning sheets are attached by various means to the under surfaces of the mop heads. The sheets are made from a variety of materials, ranging from simple cotton cloth which, when damp or containing dust spray, attracts dust, to sheets made of non-woven synthetic cloth type material which generate a minimal electrostatic charge. The static charge in this material serves to attract and accumulate dust efficiently from dry surfaces. When such cleaning sheets are completely loaded with accumulated dust, the sheets can be washed or reused, but most conveniently, they are simply removed from the mop head, discarded, and the mop replaced with a fresh sheet.

This cleaning procedure is very effective in removing dust and like dirt. However, it has an inherent problem. When the cleaning sheets become full of dust and must be replaced, access to fresh sheets logistically is cumbersome and often time consuming. Replacement of a cleaning sheet compels the user to interrupt his or her work and obtain a new sheet from a location remote from the area in which the cleaning is being done, like a cleaning storage closet or pantry. Each time a cleaning sheet needs to be replaced, cleaning must be stopped and unless the user somehow has a new sheet or sheets on his or her person, a replacement sheet must be found and brought back to the work area. Existing dust mop devices do not have a means to contain and store replacement cleaning sheets. The present invention provides a solution to this problem.

SUMMARY OF INVENTION

It is thus an object of the present invention to provide a dust mop which overcomes the limitations and disadvantages of prior devices.

It is an object of the present invention to provide a dust mop which allows for the simple and effective replacement of dust cleaning sheets, with a minimal of work interruption or downtime.

It is a further object of the present invention to provide a dust mop which allows for the simple, immediate, and effective replacement of dust cleaning sheets.

It is another object of the present invention to provide a dust mop with the simple and most convenient ability to contain and store replacement cleaning sheets for use on the mop.

It is a further object of the present invention to provide a dust mop with a mop head which contains one or more compartments for the storage of replacement cleaning sheets.

It is still another object of the present invention to provide a dust mop which allows easy access to replacement cleaning sheets stored in one or more compartments in the mop head.

It is another object of the present invention to provide a dust mop which permits ready replacement of additional cleaning sheets to be stored for use in the mop's head.

These and other objects are accomplished by the present invention which comprises a dust mop with a handle and attached mop head containing one or more compartments. The compartments within the base of the mop head are used to store replacement electro-static dust accumulating cleaning sheets. As the cleaning sheet in use on the mop head becomes full of dust, it is removed from the mop head and discarded. A fresh sheet is simply and conveniently retrieved from a compartment in the mop head and immediately replaced on the cleaning surface of the head. There is no interruption of work or downtime in searching for a replacement sheet or finding one in a remote location. This mop head configuration provides an efficient and effective means of performing the dust moping procedure. Different mop bases are disclosed which employ several alternate means for removal of cleaning sheets from the mop head.

The novel features which are considered as being characteristic of the invention are set forth in particular in the appended claims. The dust mop itself, however, both as to its design, construction, and use, together with additional features and advantages thereof, are best understood upon a review of the following detailed description with reference to the accompanying drawings.

DETAILED DESCRIPTION OF THE INVENTION

Figure 2:
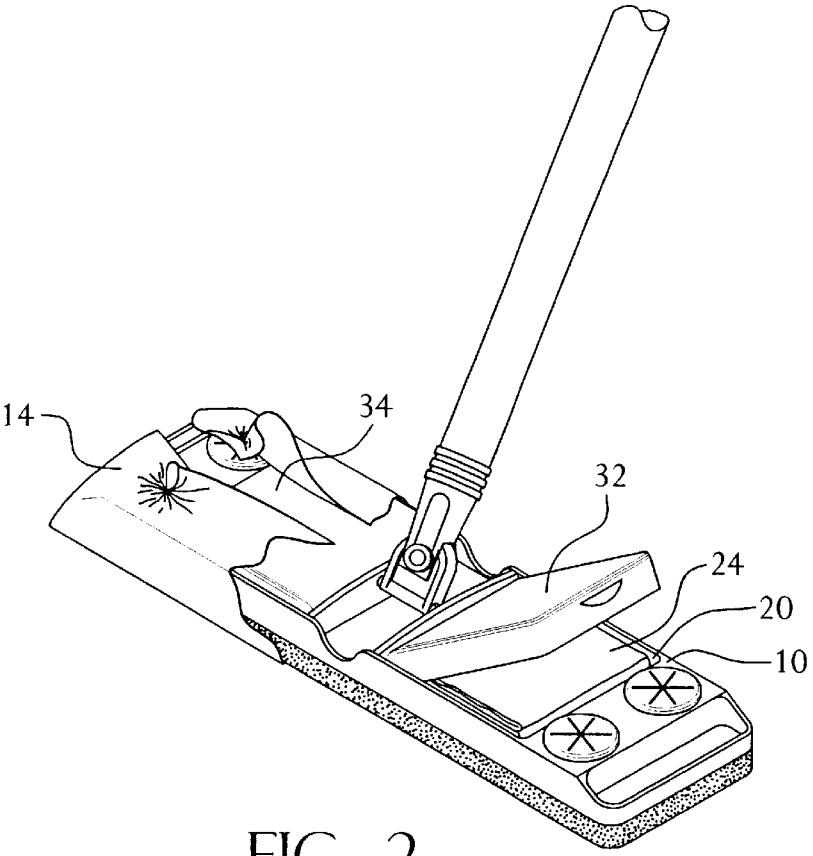
FIG. 2 is an isometric view of the mop shown in FIG. 1, with an in-use cleaning sheet in place and one of the mop's dual covers in an open position.
Figure 1:
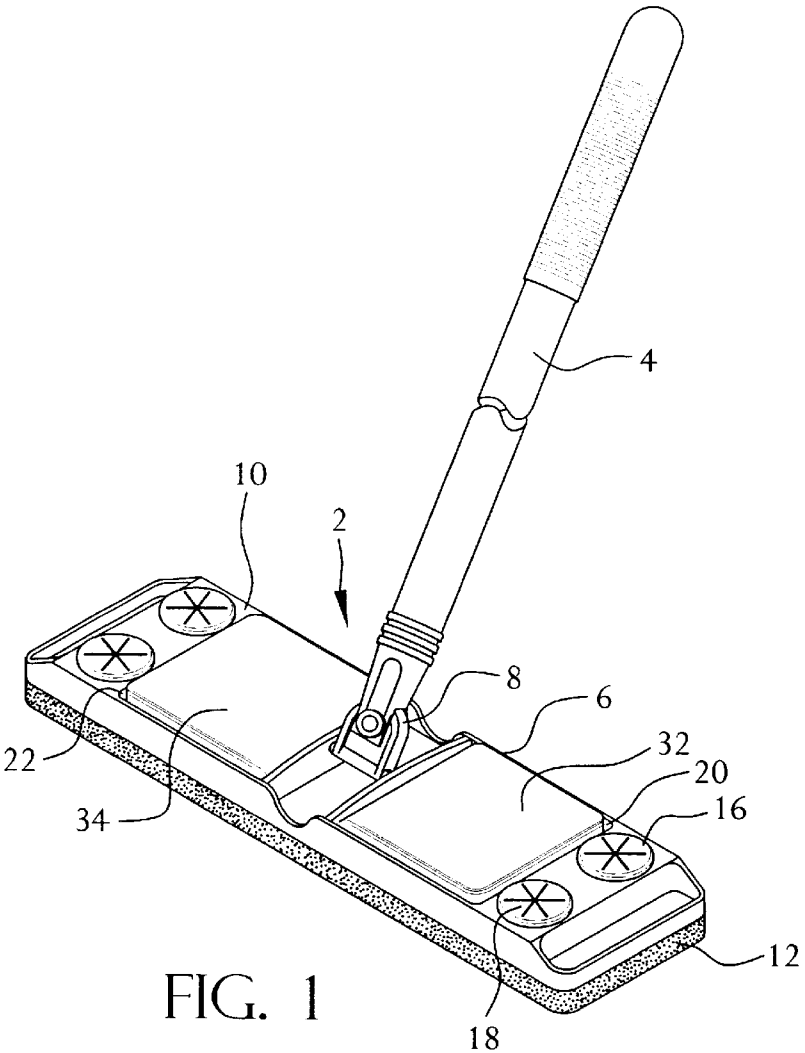
FIG. 1 is an isometric view of a mop employing the dust mop head of the invention.

Referring to FIG. 1, mop 2 comprises handle 4 and mop head 6. Handle 4 is connected to mop head 6 by attachment connection 8 which is common to the art. Mop head 6 comprises mop base 10, attached to foam-like pad cleaning surface 12, over which is positioned a cleaning aid, a disposable or reusable cleaning sheet 14, as shown in FIG. 2. Cleaning sheet 14 is maintained in position over cleaning surface 12 on mop head 6 by known means, like resilient biased members 16 on mop base 10. Member 16 consists of separated segments 18 which are flexibly biased, such that by pushing a portion of cleaning sheet 14 through and into segments 18, as shown in FIG. 2, the segments serve to hold and secure that portion of sheet 14 which is in place within member 16. It is contemplated that other devices may also be used to hold and maintain sheet 14 in place on mop base 10. For example, reference is made to the resilient mop head clips disclosed in U.S. Pat. No. 5,915,437.

Figure 4:
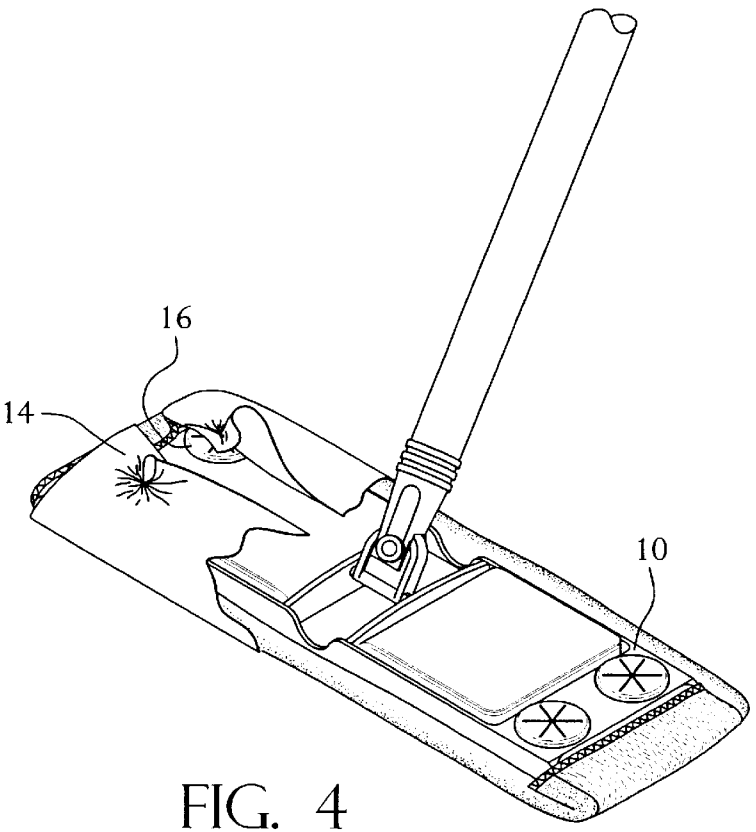
FIG. 4 is an isometric view of the mop shown in FIG. 3, with an in-use cleaning sheet in place.
Figure 3:
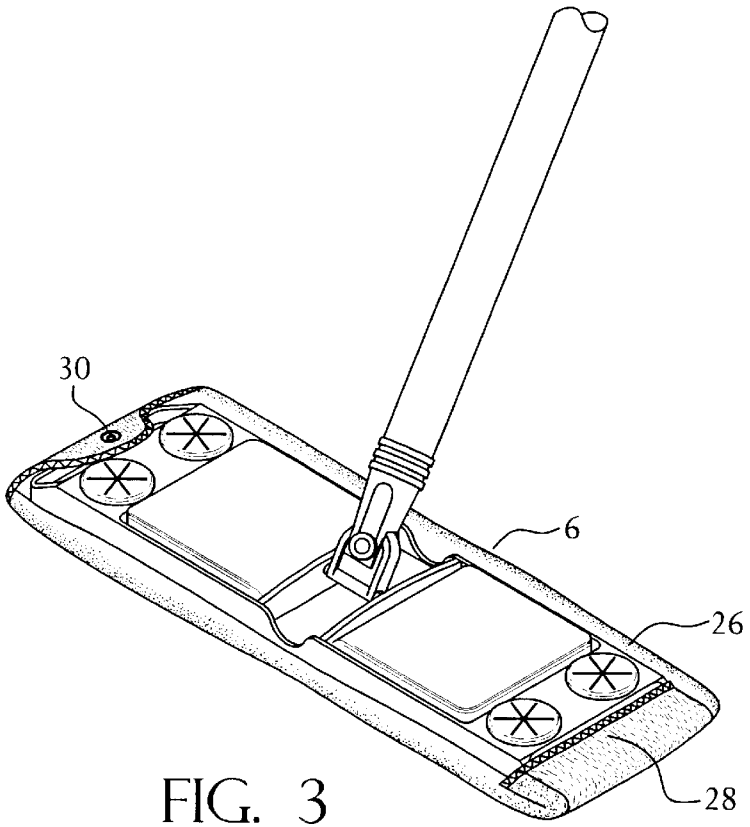
FIG. 3 is an isometric view of a mop similar to that which is shown in FIG. 1, except with a cloth pad cleaning surface.
Figure 6:
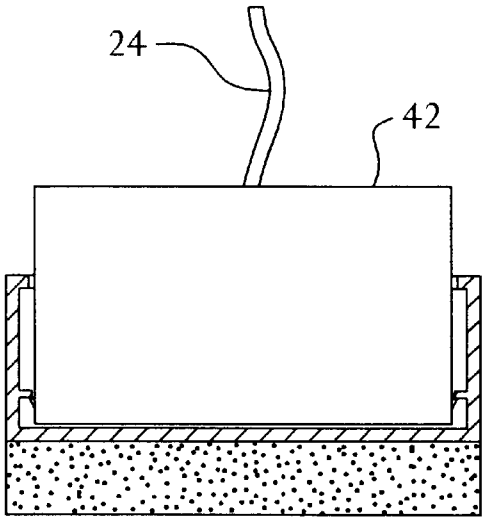
FIG. 6 is a cross section view taken from FIG. 5.

The cleaning surface of mop head 6 must be soft and pliant so that when used over floor or wall surfaces, even with overlaid cleaning sheet 14, there will be no scrapping or other damage to these surfaces. Thus, foam pad cleaning surface 12 is employed. As an alternative, a cloth or other woven fabric or similar type material pad 26, as shown in FIG. 3, can be used to cover mop head 6. Pad 26 is positioned on mop head 6 by inserting the head into one end 28 of the pad and securing the other end onto the head, using, for example, snap connection 30. Cleaning sheet 14 is then positioned over pad 26 and secured, as described above, to mop head 6 via members 16, as shown in FIG. 4.

Mop head 6 comprises enclosed spaces, i.e. compartments 20 and 22 which are formed within the confines of mop base 10. Compartments 20 and 22 contain and store fresh replacement cleaning sheets 24, which are appropriately folded and positioned in the compartments. Access to compartments 20 and 22 is gained through covers 32 and 34, which are each pivotally mounted on mop base 10, over compartments 20 and 22 respectively. Thus, when in use, cleaning sheet 14 becomes full of dust and a fresh cleaning sheet is required, sheet 14 is removed from members 16 on mop head 6. Either cover 32 or 34 is opened and a replacement sheet 24 can easily and conveniently be removed from compartments 20 or 22 and the cover replaced in its closed position. Sheet 24 is then quickly and easily replaced over cleaning surface 12 of mop head 6, by insertion into members 16.

Figure 5:
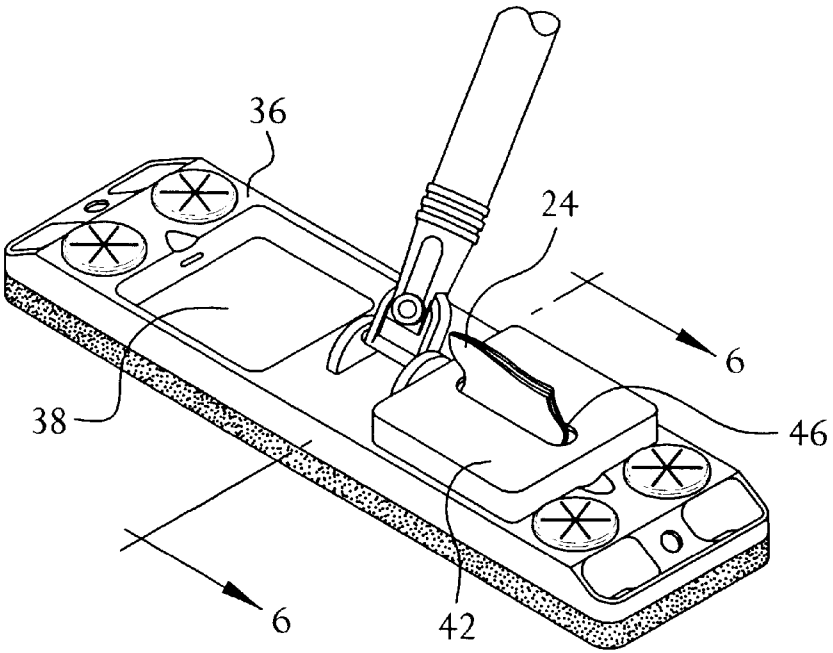
FIG.5 is an isometric view of an alternate embodiment of the invention.

An alternative mop head configuration is shown in FIG. 5. Mop base 36, like mop base 10, comprises similar compartments, one of which is shown at 38, and pivoted covers, one of which is shown at 42. However, cover 42 also comprises dispensing slot opening 46 through which replacement cleaning sheets 24, folded within compartment 38, can be dispensed, tissue style. Replacement cleaning sheets 24 are similarly folded and stored within the corresponding compartment over which cover 42 is positioned. When a replacement cleaning sheet 24 is needed, it is simply pulled out of one of the compartments. Another replacement cleaning sheet pops up through slot opening 46, the slot opening in the cover on the opposite side of mop base 36, to take its place.

Figure 7:
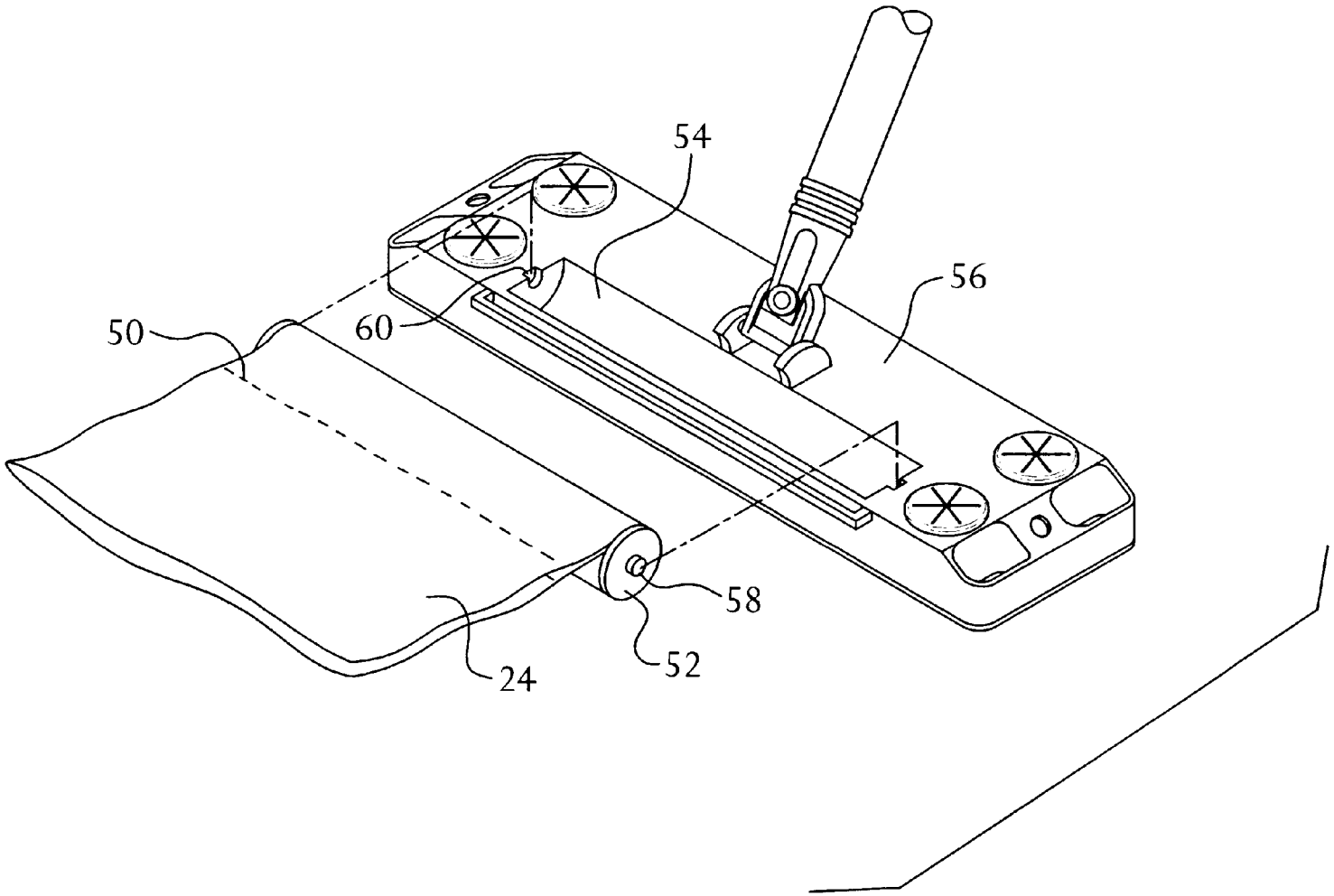
FIG. 7 is an isometric view of a further alternate embodiment of the invention.

Another alternative mop head configuration is shown in FIG. 7. In this embodiment, a series of replacement cleaning sheets 24 inter-connected by perforations 50, are positioned around roller cartridge 52. Roller cartridge 52 is positioned within elongated compartment 54, formed within mop base 56. Roller cartridge 52 is mounted for rotatable movement within compartment 54 by placement of roller ends 58 into roller openings 60. When a replacement cleaning sheet 24 is needed, the new sheet can simply be pulled off roller cartridge 52. When roller cartridge 52 is emptied of cleaning sheets 24, the used roller cartridge is removed and a new one dropped into compartment 54 in its place.

Figure 9:
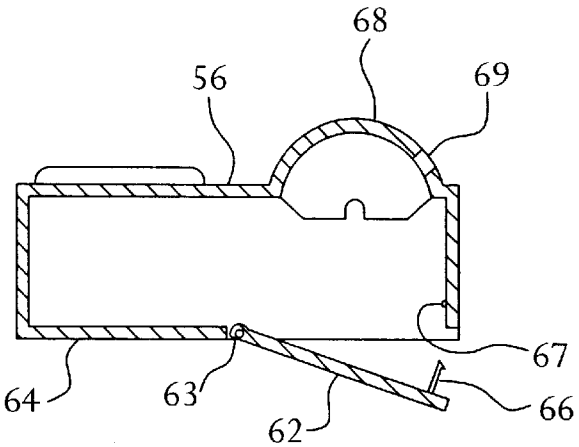
FIG. 9 is a cross-section taken from FIG. 8.
Figure 8:
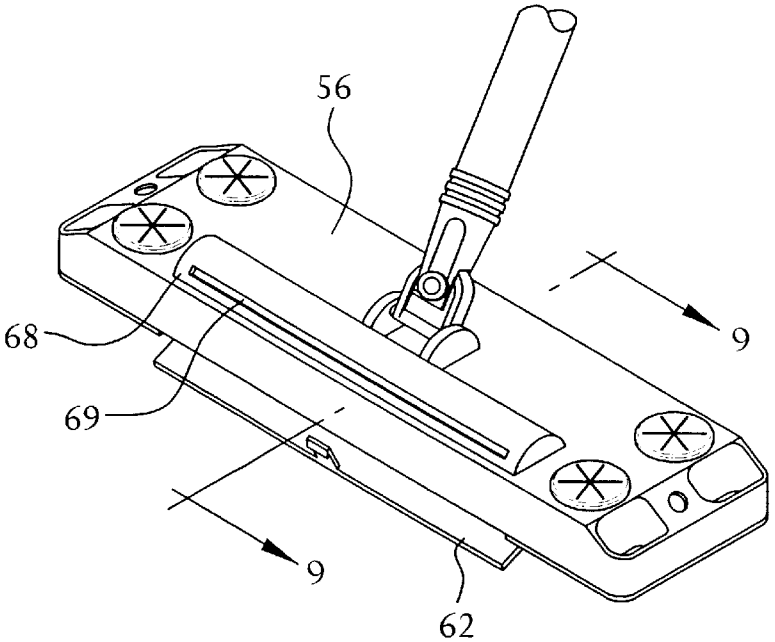
FIG. 8 is an isometric view of an alternate embodiment of the mop shown in FIG. 7.

Alternatively, a used roller cartridge can be replaced through pivotally hinged door 62, permanently connected by hinge 63 to lower surface 64 of mop base 56, as shown in FIGS. 8 and 9. Door 62 is secured closed by means of lock tab system 66 and 67. It is contemplated that, in this embodiment, mop base 56 would have a protective shroud 68, overlaying and covering enclosed compartment 54. Shroud 68 has dispensing slot 69, through which cleaning sheets are removed.

Figure 10:
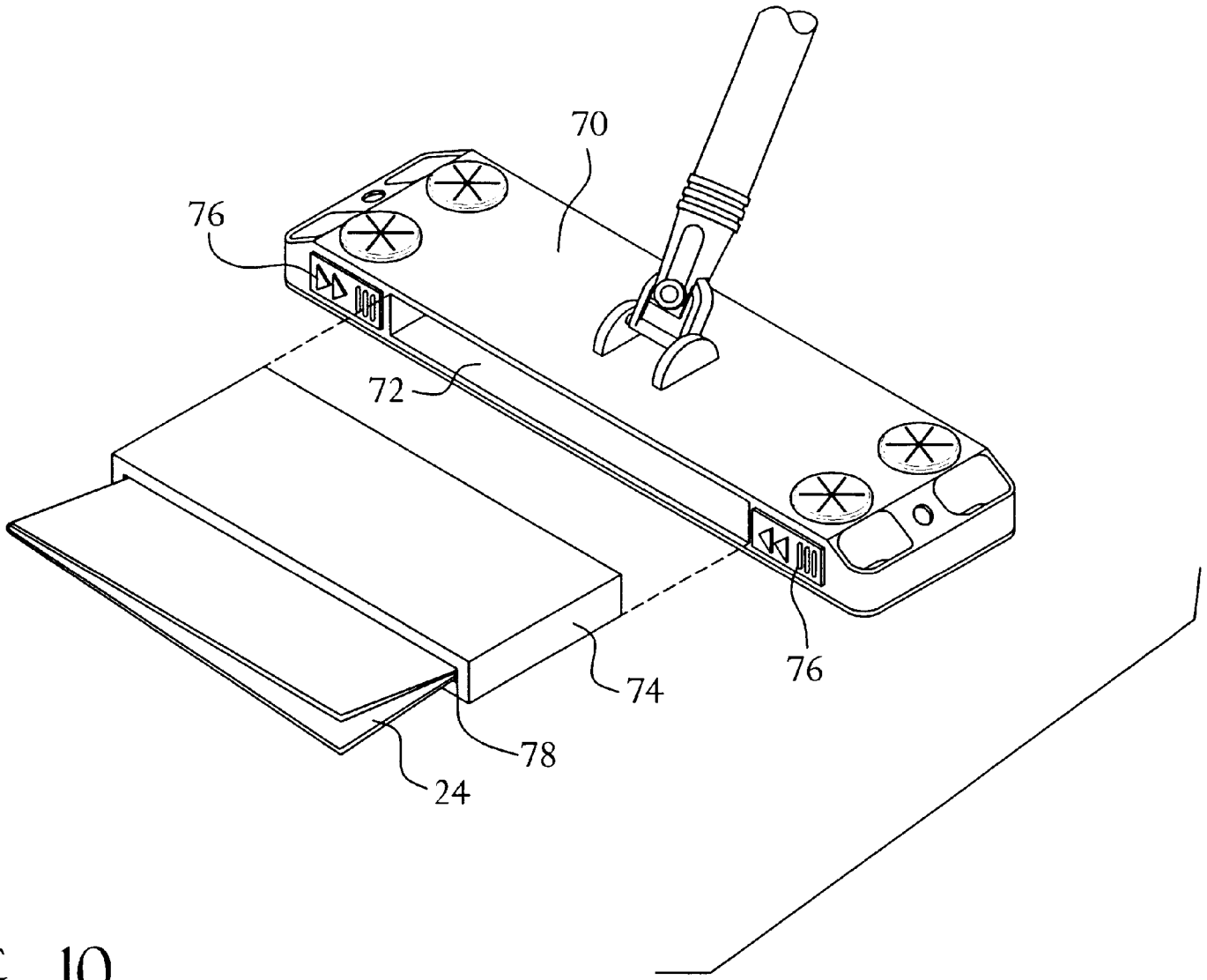
FIG. 10 is an isometric view of still another embodiment of the invention.

Another alternative mop head configuration is shown in FIG. 10. In this embodiment, mop base 70 comprises internally enclosed compartment 72 formed within the base. Cleaning sheet box 74, which contains folded replacement cleaning sheets 24, is configured to be inserted into and remain in compartment 72. Once box 74 is placed in compartment 72 within mop base 70, slidable locking tabs 76 are moved inward to lock the box in place within the compartment. A replacement cleaning sheet 24 can be removed for use, when needed, by pulling the sheet out of box 74, through its dispensing slot 78. Another cleaning sheet pops from box 74 after the exposed one is pulled out.

When box 74 is emptied of cleaning sheets 24, lock tabs 76 are pushed outward and the box is removed from mop base 70. A new box 74, filled with fresh replacement cleaning sheets 24, is then reinserted into and locked within mop base 70.

Figure 12:
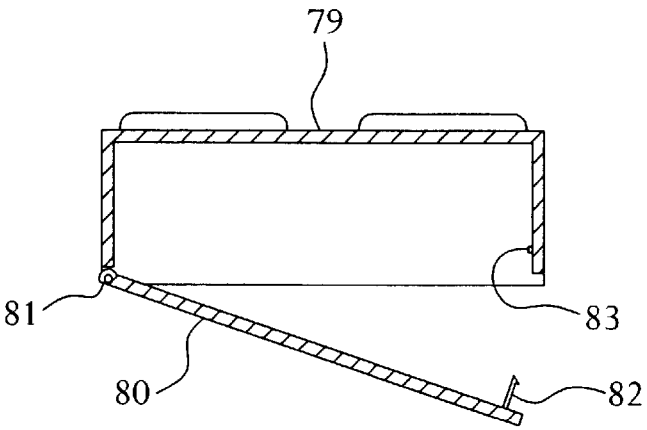
FIG. 12 is a cross-section taken from FIG. 11.
Figure 11:
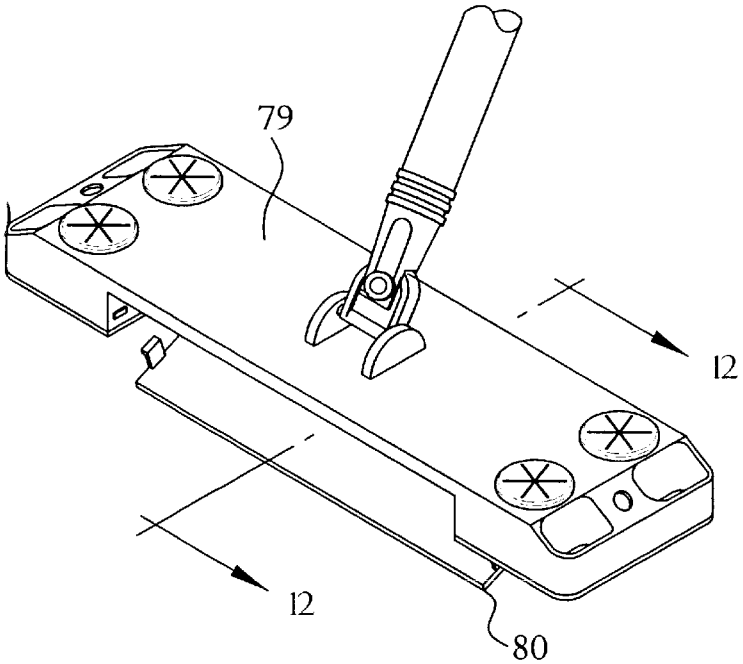
FIG. 11 is an isometric view of an alternate embodiment of the mop shown in FIG. 10.

Alternatively, a used box 74 can be replaced through mop base floor 80, which is pivotally connected to mop base 79 at 81, as shown in FIGS. 11 and 12. Floor 80 is secured closed by means of lock tab system 82 and 83.

Thus, this invention presents the dust mop user with an appliance, whose mop head conveniently and simply stores a multitude of cleaning aids in the form of cleaning sheets, which are immediately and readily accessible for immediate use on the dust mop.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed:

1. A mop comprising a handle attached to a cleaning head, said cleaning head comprising:

a cleaning surface and mop base means for supporting the cleaning surface, said mop base means comprising:

a. handle connection means for securing the handle to said mop base means;

b. compartment means formed within the mop base means for containing and storing cleaning aids; and c. cleaning aid attachment means for maintaining an in-use cleaning aid in position over the cleaning head.

2. A mop as in claim 1 wherein the cleaning aid attachment means maintains the in-use cleaning aid in position over the cleaning surface.

3. A mop as in claim 1 wherein the cleaning surface is a fabric-like pad, detachably connected to the mop base means by pad attachment means.

4. A mop as in claim 3 wherein the pad attachment means comprises a snap connection device.

5. A mop as in claim 1 wherein the cleaning surface is a foam-like pad attached to the mop base means.

6. A mop as in claim 1 wherein the compartment means is located totally within the confines of the mop base means and over the cleaning surface.

7. A mop as in claim 1 wherein the compartment means is an enclosed space within the mop base means.

8. A mop as in claim 7 wherein the cleaning head further comprises cleaning aid insert means for placement, by insertion, into the enclosed space within the mop base means.

9. A mop as in claim 8 wherein the insert means is configured to contain stored cleaning aids.

10. A mop as in claim 8 wherein the mop base means further comprises insert locking means for securing the insert means within the mop base means.

11. A mop as in claim 9 wherein the cleaning aids comprise cleaning sheets contained and stored in the insert means.

12. A mop as in claim 10 wherein the insert locking means comprises a tab locking system.

13. A mop as in claim 8 wherein the mop base means further comprises a bottom floor means pivotally connected to the mop base means which, when the floor means is opened, the insert means may be inserted and placed within the mop base means or removed from the mop base means.

14. A mop as in claim 13 wherein the mop base means further comprises insert locking means for securing the insert means within the mop base means.

15. A mop as in claim 14 wherein the insert locking means comprises a tab locking system.

16. A mop as in claim 1 wherein the mop base means further comprises covers located over and enclosing the compartment means.

17. A mop as in claim 16 wherein the covers are pivotally connected to the base means, allowing opening of the compartment means for the placement and removal of cleaning aids.

18. A mop as in claim 1 wherein the compartment means comprises dual compartment spaces.

19. A mop as in claim 1 wherein the mop base means further comprises opening means located over the compartment means for permitting removal of cleaning aids from the cleaning head.

20. A mop as in claim 19 wherein the opening means are located in covers over the compartment means.

21. A mop as in claim 20 wherein the opening means comprise dispensing slots through which cleaning aids are removed from the compartment means.

22. A mop as in claim 1 wherein the cleaning aids comprise cleaning sheets.

23. A mop as in claim 22 wherein the cleaning sheets are configured to be folded and stored in the compartment means.

24. A mop as in claim 22 wherein the cleaning sheets are located in the compartment means and the compartment means comprises covers with opening means through which the cleaning sheets are removed from the compartment means.

25. A mop as in claim 22 wherein the base means further comprises cleaning sheet roller means for storing and dispensing cleaning sheets from the mop base means.

26. A mop as in claim 25 wherein the roller means is located in the compartment means.

27. A mop as in claim 26 wherein the roller means is enclosed within the compartment means by a cover overlying the compartment means.

28. A mop as in claim 27 wherein the cover comprises a dispensing slot for removal of cleaning sheets.

29. A mop as in claim 25 wherein the mop base means further comprises a bottom door means pivotally connected to the mop base means which, when the door means is opened, the roller means may be inserted and placed within the mop base means or removed from the mop base means.

30. A mop as in claim 29 wherein the mop base means further comprises roller door locking means for securing the door means and maintaining the roller means within the mop base means.

31. A mop as in claim 30 wherein the roller door locking means comprises a tab locking system.

32. A mop as in claim 22 wherein the cleaning aid attachment means secures and maintains an in-use cleaning sheet in position over the cleaning surface.

33. A mop as in claim 32 wherein the cleaning aid attachment means comprises resilient, flexibly biased members which hold the in-use cleaning sheet in place over the cleaning surface.

34. A mop comprising a handle attached to a cleaning head, said cleaning head comprising:

a cleaning surface;

a cleaning sheet overlying the cleaning surface; and a mop base attached to the cleaning surface, said mop base comprising:

a. handle connection means for securing the handle to said mop base;

b. compartment means formed within the confines of the mop base for containing and storing extra cleaning sheets; and c. cleaning sheet attachment means for maintaining an in-use cleaning sheet in position overlying the cleaning surface.

35. The mop as in claim 34 wherein the cleaning surface is a fabric-like pad, detachably connected to the mop base by pad attachment means.

36. A mop as in claim 35 wherein the pad attachment means comprises a snap device.

37. A mop as in claim 34 wherein the cleaning surface is a foam-like pad attached to the mop base.

38. The mop as in claim 34 wherein the base further comprises covers which are pivotally mounted to the mop base over the compartment means, allowing opening of the compartment means for the placement and removal of cleaning sheets.

39. The mop as in claim 34 wherein the compartment means comprises dual compartment spaces.

40. A mop as in claim 34 wherein the mop base further comprises opening means located over the compartment means for permitting removal of the stored cleaning sheets from the cleaning head.

41. A mop as in claim 40 wherein the opening means are located in covers over the compartment means.

42. A mop as in claim 41 wherein the opening means comprises dispensing slots through which the cleaning sheets are removed from the compartment means.

43. A mop as in claim 34 wherein the stored cleaning sheets are configured to be folded and located in the compartment means.

44. A mop as in claim 34 wherein the cleaning sheets are located in the compartment means and the compartment means comprises covers with opening means through which the extra stored cleaning sheets are removed from the compartment means.

45. A mop as in claim 34 wherein the base further comprises cleaning sheet roller means for storing and dispensing the cleaning sheets from the mop base.

46. A mop as in claim 45 wherein the roller means is located in the compartment means.

47. A mop as in claim 45 wherein the roller means is enclosed within the compartment means by a cover overlying the compartment means.

48. A mop as in claim 47 wherein the covet comprises a dispensing slot for removal of cleaning sheets.

49. A mop as in claim 45 wherein the mop base further comprises a bottom door means pivotally connected to the mop base which, when the door means is opened, the roller means may be inserted and placed within the mop base or removed from the mop base.

50. A mop as in claim 49 wherein the mop base further comprises roller door locking means for securing the door means and maintaining the roller means within the mop base.

51. A mop as in claim 50 wherein the roller door locking means comprises a tab locking system.

52. A mop as in claim 34 wherein the compartment means is an enclosed space within the mop base.

53. A mop as in claim 52 wherein the cleaning head further comprises cleaning sheet insert means for placement, by insertion, into the enclosed space within the mop base.

54. A mop as in claim 53 wherein the insert means is configured to contain and store cleaning sheets.

55. A mop as in claim 53 wherein the mop base further comprises insert locking means for securing the insert means within the mop base.

56. A mop as in claim 55 wherein the insert locking means comprises a tab locking system.

57. A mop as in claim 53 wherein the mop base further comprises a bottom floor means pivotally connected to the mop base which, when the floor means is opened, the insert means may be inserted and placed within the mop base or removed from the mop base.

58. A mop as in claim 57 wherein the mop base further comprises insert locking means for securing the insert means within the mop base.

59. A mop as in claim 58 wherein the insert locking means comprises a tab locking system.

60. A mop as in claim 34 wherein the cleaning aid attachment means comprises resilient, flexibly biased members which hold a cleaning sheet in place on the mop base over the cleaning surface.

* * * * *